US005721531A

United States Patent [19]

Garver et al.

[11] Patent Number: 5,721,531

[45] Date of Patent: Feb. 24, 1998

[54] MONITORING ARRANGEMENT FOR ELECTRONIC FILE FOLDER LOCATOR SYSTEM

[75] Inventors: William Joseph Garver, Harrisburg; James Albert Leidy, Hummelstown; Donald Lynn Metzger, Harrisburg; James Henry Wise, Hummelstown, all of Pa.

[73] Assignee: The Whitaker Corporation, Wilmington, Del.

[21] Appl. No.: 496,148

[22] Filed: Jun. 28, 1995

[51] Int. Cl.[6] ..... G08B 13/14

[52] U.S. Cl. ..... 340/568; 340/570; 340/572; 340/825.54; 414/273; 235/385

[58] Field of Search ..... 340/568, 570, 340/571, 572, 825.52, 825.54; 235/383, 385; 414/273; 364/DIG. 1, 226.3, 226.6, DIG. 2, 920.6

[56] References Cited

U.S. PATENT DOCUMENTS

| | | | |
|---|---|---|---|
| 3,701,987 | 10/1972 | Leighton | 340/570 |
| 4,862,160 | 8/1989 | Ekchian et al. | 340/825.54 |
| 5,063,380 | 11/1991 | Wakura | 340/825.54 |
| 5,287,414 | 2/1994 | Foster | 382/1 |
| 5,424,858 | 6/1995 | Gillotte | 359/143 |

FOREIGN PATENT DOCUMENTS 2 667 183 3/1992 France .

*Primary Examiner*—Jeffery Hofsass
*Assistant Examiner*—Ashok Mannava

[57] ABSTRACT

This invention relates to a monitoring arrangement for a hanging file folder for identifying information contained in an electronic file folder locator system. A hanging file folder, as known in the art, includes a pair of laterally extending support bars along a pair of upper edges of the file folder wherein each upper edge is formed with a channel for holding a respective support bar, and the file folder is formed with a plurality of apertures into one of the upper edge channels at a plurality of spaced locations along that channel. The monitoring arrangement comprises a pair of parallel, substantially horizontal, support rails spaced apart within a file cabinet to suspend the file folder therebetween. Further, there is provided a file folder label holder containing an addressable switch and a memory storing identifying information unique to the file folder, the label holder having a tab adapted to extend into a file folder upper edge aperture for mounting the label holder to the file folder, and a first pair of conductive lines extending along at least one of the support rails and adapted for connection to a communications bus of the electronic file folder locator system. Finally, a second pair of conductive lines are provided to extend along the one support bar within its channel of the file folder having the plurality of apertures, the second pair of conductive lines being located on the one support bar for contact with respective ones of the first pair of conductive lines when the file folder is supported on the pair of support rails, and circuitry within the label holder coupled to the addressable switch and the memory.

6 Claims, 4 Drawing Sheets

MONITORING ARRANGEMENT FOR ELECTRONIC FILE FOLDER LOCATOR SYSTEM

BACKGROUND OF THE INVENTION

This invention relates generally to a filing system which stores file folders within a plurality of file cabinet drawers and, more particularly, to an electronic system which monitors and indicates the location of any particular desired file folder within the filing system.

In a large modern office, there is often a central file room containing dozens of multi-drawer file cabinets, with each drawer holding tens of file folders. It will be appreciated that maintaining the folders in an orderly fashion so that they may be properly stored and easily retrieved can be an arduous task. There are many manual systems available wherein, for example, the folders can be stored in alphabetical or numerical order, or the folders can be color-coded. All such manual systems require that each folder be stored in its proper place so that retrieval of a particular folder does not require searching through all of the folders in all of the drawers.

To alleviate some of the problems associated with such a manual system, automated systems have been proposed. One such automated file locator system is disclosed in U.S. Pat. No. 5,287,414, wherein each of the file folders is provided with a machine readable code on a tab secured to the folder. Whenever a file cabinet drawer is opened or closed, the codes on the folders within that drawer are scanned by a scanner associated with the drawer and input to a computer system which stores a list of the folders in each drawer. When a user wishes to locate a particular folder, the folder's identification is entered into the computer system by the user. The system then searches through its list and causes a light associated with the file cabinet drawer containing that folder to be illuminated. As the user opens that drawer, the codes on the folders therein are scanned and the user is alerted when the desired folder is under the scanner. This system has certain disadvantages, some due to the fact that it requires movement of a file drawer to "read" and identify a file folder.

Another automated system is disclosed in French Patent Publication No. 2,667,183. This document discloses a system wherein each folder has an identification label which includes an infrared sensor and an indicator. A scanning device transmits coded infrared signals corresponding to the identification of a desired folder. When the identification label of that folder senses its own identification signal, the indicator is energized. This system requires that the identification labels for all of the folders be exposed. It further requires that all of the identification labels be manually scanned for each folder request.

It is therefore an object of the present invention to provide a file folder locator system which does not require that file cabinet drawers be moved in order to determine which folders are contained within a drawer, which does not require that the folder identification labels be exposed, and which does not require the manual scanning of all the folder labels to locate a desired folder.

It is another object of this invention to provide such a system which responds to a folder location request by providing a visual indication of the file cabinet drawer containing the requested folder and also by providing a visual indication on the requested folder itself.

SUMMARY OF THE INVENTION

The foregoing and additional objects are attained in accordance with the principles of this invention by providing a file folder locator system comprising memory means associated with the folder for storing identification information unique to the folder, and support means for holding the folder, with the support means including a plurality of electrically conductive lines. The system also comprises a communications bus, connection means for coupling the communications bus to the support means conductive lines, coupling means including a transceiver for coupling the memory means to the conductive lines when the folder is held by the support means, and an indicator associated with the folder and coupled to the transceiver. Control means coupled to the communications bus is effective for receiving the identification information from the folder memory means, for comparing the identification information with a folder location request, for identifying the folder upon detecting a match between the request and identification information, and for energizing the indicator when the folder is identified by the match.

In accordance with a preferred embodiment of this invention, the system further includes a folder label holder supporting the memory means, the transceiver and the indicator. Each upper edge of the hanging folder is formed with a channel holding a support bar and the folder is formed with a plurality of apertures into one of the upper edge channels at a plurality of spaced locations along the channel for providing access to the support bar within that one channel. The label holder includes a tab adapted to extend into one of the apertures for mounting the label holder to the folder, the tab including circuitry coupled to the transceiver and adapted to contact the circuitry on the support bar in that one channel.

In accordance with another aspect of this invention, the indicator is mounted to the at least one file drawer which also includes coupling means including a transceiver for coupling the indicator to the communications bus. The control means is further effective to energize the indicator on the file drawer when a match of request and identification information identifies a file folder contained within that file drawer.

In accordance with yet another aspect of this invention, the system further comprises a folder memory writing station which includes a pair of spaced parallel horizontal support rails having electrically conductive lines connected to the communications bus and adapted to support the folder with the memory means coupled to the conductive lines. The control means is further effective for transmitting identification information to the folder memory writing station to be stored by the memory means of a folder supported at that station.

BRIEF DESCRIPTION OF THE DRAWINGS

The foregoing will be readily apparent upon reading the following description in conjunction with the drawings in which like elements in different figures thereof are identified by the same reference numeral and wherein.

DETAILED DESCRIPTION

Figure 1:
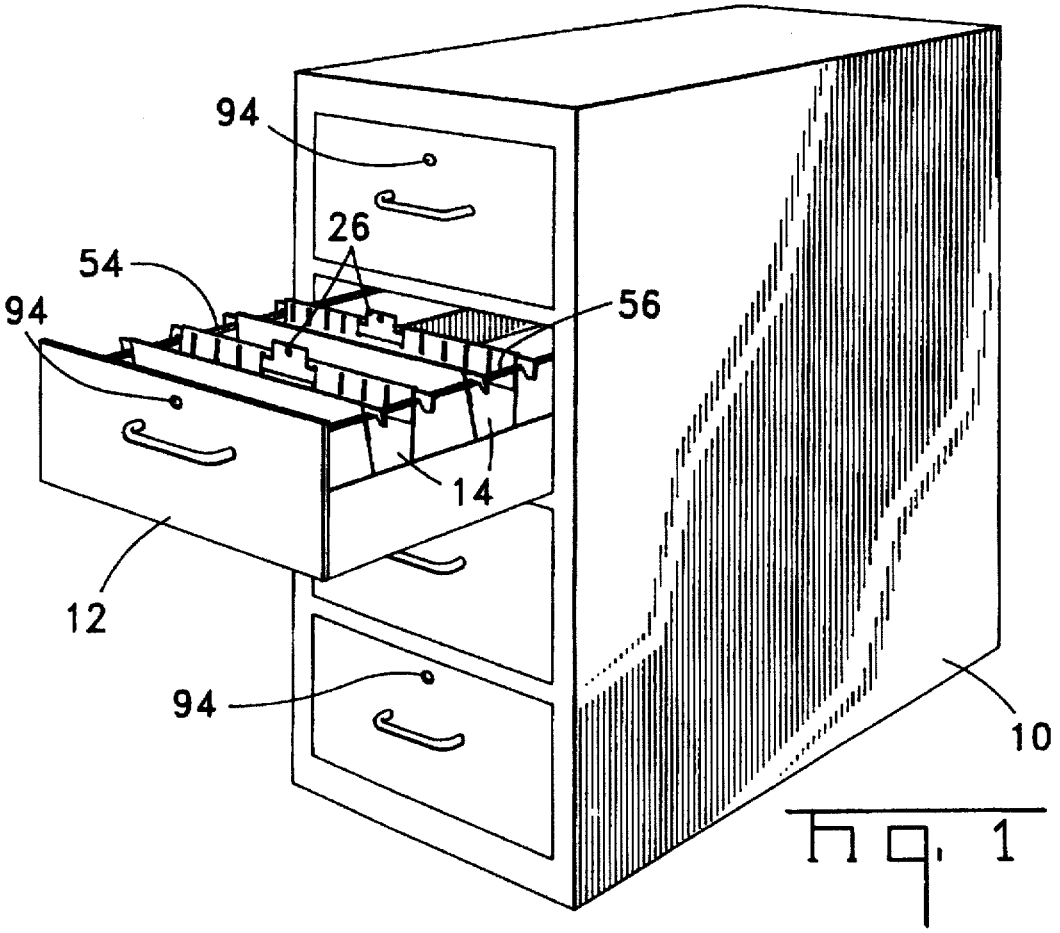
FIG. 1 is a perspective view of a standard file cabinet modified by the inclusion of a monitoring and detection arrangement in the practice of the present invention.
Figure 2:
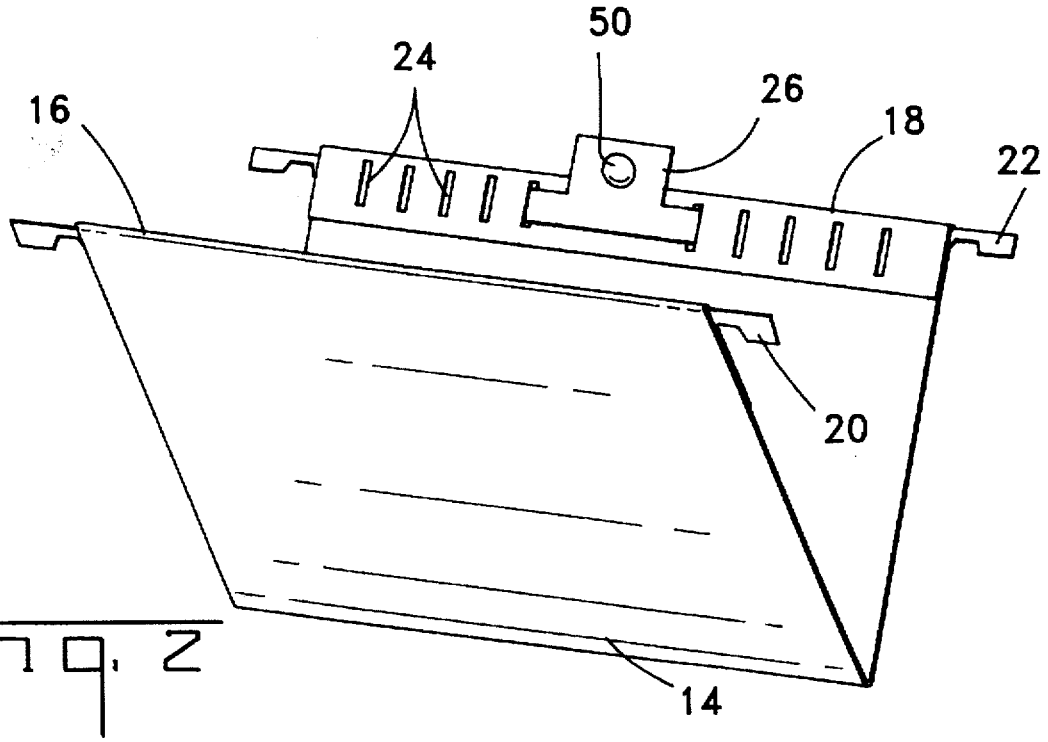
FIG. 2 is a perspective view of a standard hanging folder modified to practice this invention.

Referring to the drawings, FIG. 1 illustrates a four drawer file cabinet 10 showing the second drawer 12 open. Within the drawer 12, there are a plurality of hanging file folders 14, illustratively of the type manufactured by Esselte Pendaflex Corporation. As shown, the folders 14 are supported on a frame structure, to be described hereinafter with respect to FIG. 5. As shown in FIG. 2, the handing folder 14 has a pair of upper edges 16, 18 which are each formed by folding onto itself part of the material making up the folder sides, to thereby create a pair of channels, each of which holds a respective support bar 20, 22. The folder 14 below the upper edge 18 has formed therein a plurality of apertures 24, illustratively in the form of parallel vertical slits, into the channel and adapted to hold laterally extending tabs of a label holder 26 for mounting the label holder 26 to the folder 14. The foregoing is conventional, but the individual parts are modified according to the present invention, as will be described hereinafter.

Figures 3, 4, 5:
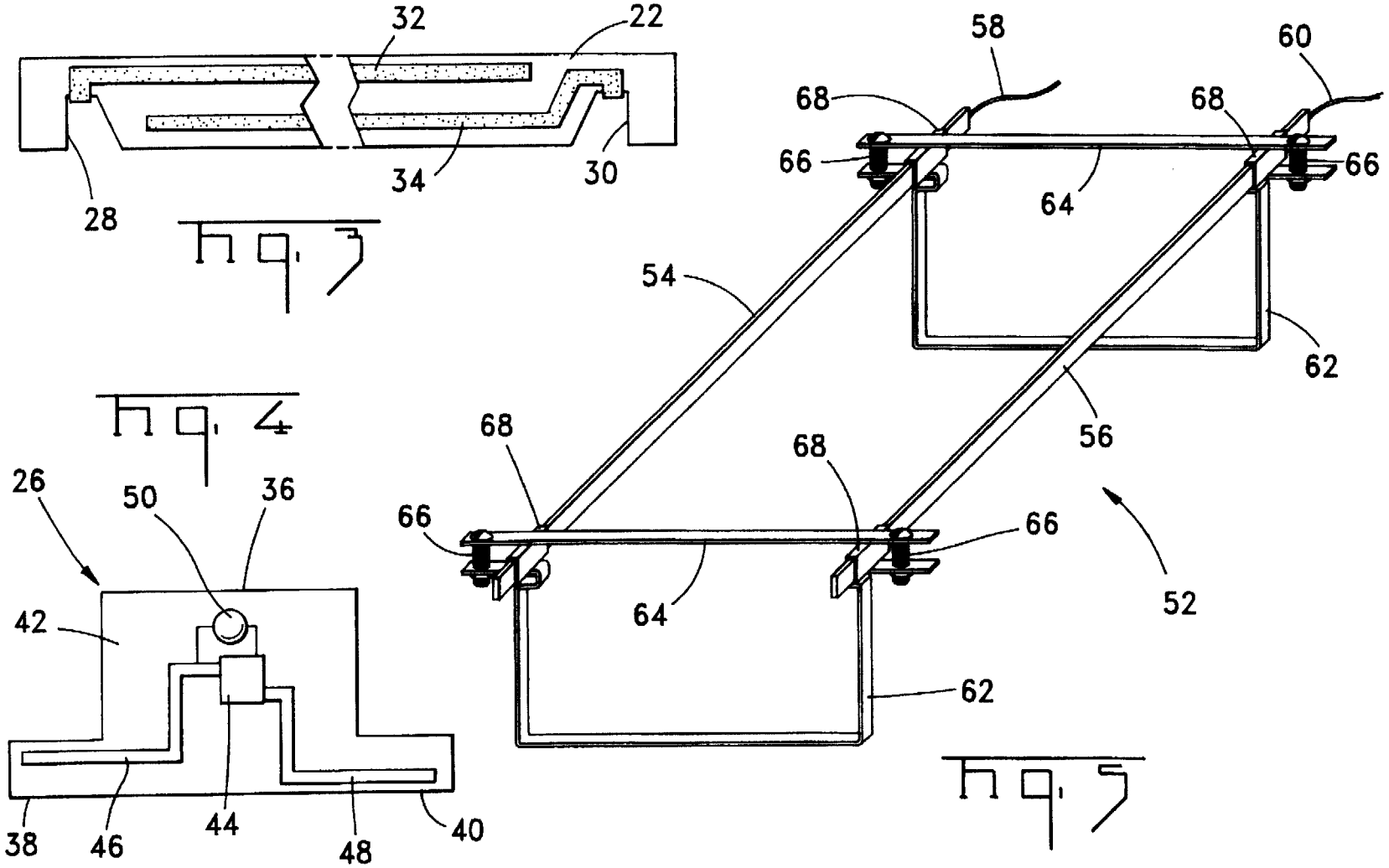
FIG. 3 shows a support bar for the hanging folder of FIG. 2 according to this invention.
FIG. 4 schematically depicts a folder label holder arrangement according to the preferred practice of invention for mounting to the file folder of FIG. 2.
FIG. 5 is a perspective view of a standard hanging folder frame modified according to this invention.

FIG. 3 illustrates the support bar 22 modified according to this invention. The support bar 22 is either formed of a dielectric material or else is coated with a dielectric material. At each of its two ends, the support bar 22 is formed with a respective notch 28, 30 which fits over the rails of a support frame, as will be described. On the surface of the support bar 22 are two conductive traces 32, 34. The traces 32, 34 are in spaced parallel relation along substantially the entire length of the support bar 22, with the upper trace 32 extending into the notch 28 and the lower trace 34 extending into the notch 30. These extensions of the traces 32, 34 continue onto the lower edge of the support bar 22 within the respective notches 28, 30 so as to contact the respective support rails on which they rest. FIG. 4 schematically depicts the folder label holder 26. Conventionally, the label holder 26 is formed from a sheet of clear stiff plastic material which is doubled over at its top edge 36 and is formed with a pair of laterally extending tabs 38, 40. The tabs 38, 40 are placed through respective ones of a pair of the apertures (slits) 24 of the folder 14 to mount the label holder 26 to the folder 14 with its major portion 42 extending above the upper edge 18 of the folder 14. As is conventional, a printed label bearing thereon identification information for the folder 14 is inserted between the two layers of clear plastic material forming the major portion 42 of the label holder 26, where it is visible for identifying the contents of the folder 14. The present invention contemplates modifying the label holder 26 by incorporating therein circuitry used for identifying and visually indicating a desired folder. Thus, as shown, incorporated within the label holder 26 is an integrated circuit chip 44 which is illustratively a type 240X address switch manufactured by Dallas Semiconductor of Dallas, Tex. The chip 44 includes a memory and a transceiver. The memory is a random access memory (RAM) into which can be written, for subsequent retrieval, information identifying the contents of the folder 14. In addition, the chip 44 contains an unique identifier (i.e., a serial number) for that specific chip which is burned into the chip during its manufacture. The chip 44 has three terminals—a data/power terminal, a ground terminal and an input/output terminal. The ground and data/power terminals of the chip 44 are connected to the traces 46 and 48, respectively, which extend along the tabs 38 and 40, respectively. The traces 46, 48 are vertically offset from each other and are exposed at the rear of the label holder 26 so that when the tabs 38, 40 are inserted through the apertures 24 the conductive traces 46, 48 contact the traces 32, 34, respectively, on the support bar 22. (It is understood that both the traces 46, 48 can be on one of the tabs 38, 40.) Also included as part of the circuitry within the label holder 26 is a light emitting diode 50 connected between the input/output terminal of the chip 44 and the ground trace 46.

FIG. 5 illustrates a frame 52 of the type commonly utilized to support a plurality of hanging folders of the type shown in FIG. 2, which frame has been modified according to this invention. Thus, the frame 52 includes a pair of spaced parallel horizontal support rails 54, 56. The upper edges of the rails 54, 56 have electrically conductive traces thereon connected to the wires 58, 60, respectively. Alternative constructions for the support rails 54, 56 include conductive rails which are entirely exposed, conductive rails covered with a dielectric coating leaving the upper edges exposed, conductive rails having a dielectric coating with a conductive trace deposited on the upper surface, and rails formed of dielectric material having conductive traces coated on their upper surfaces. In any event, what is desired is that the conductive traces 32, 34 on the support bar 22 which extend into the respective notches 28, 30 be electrically coupled to the wires 58, 60, when the hanging folder 14 is supported on the frame 52.

The frame 52 further includes a pair of uprights 62 and a pair of clamping bars 64. The rails 54, 56 are held between the uprights 62 and the clamping bars 64 by screw members 66, as is conventional. Surrounding each of the rails 54, 56, where it is held by the uprights 62 and the clamping bar 64, is an insulative sleeve 68. Thus, the rail 54 is electrically isolated from the rail 56. Although a separate frame structure 52 is shown, it is understood that the rails 54, 56 can be incorporated as part of the construction of the file cabinet drawer 12.

Figure 6:
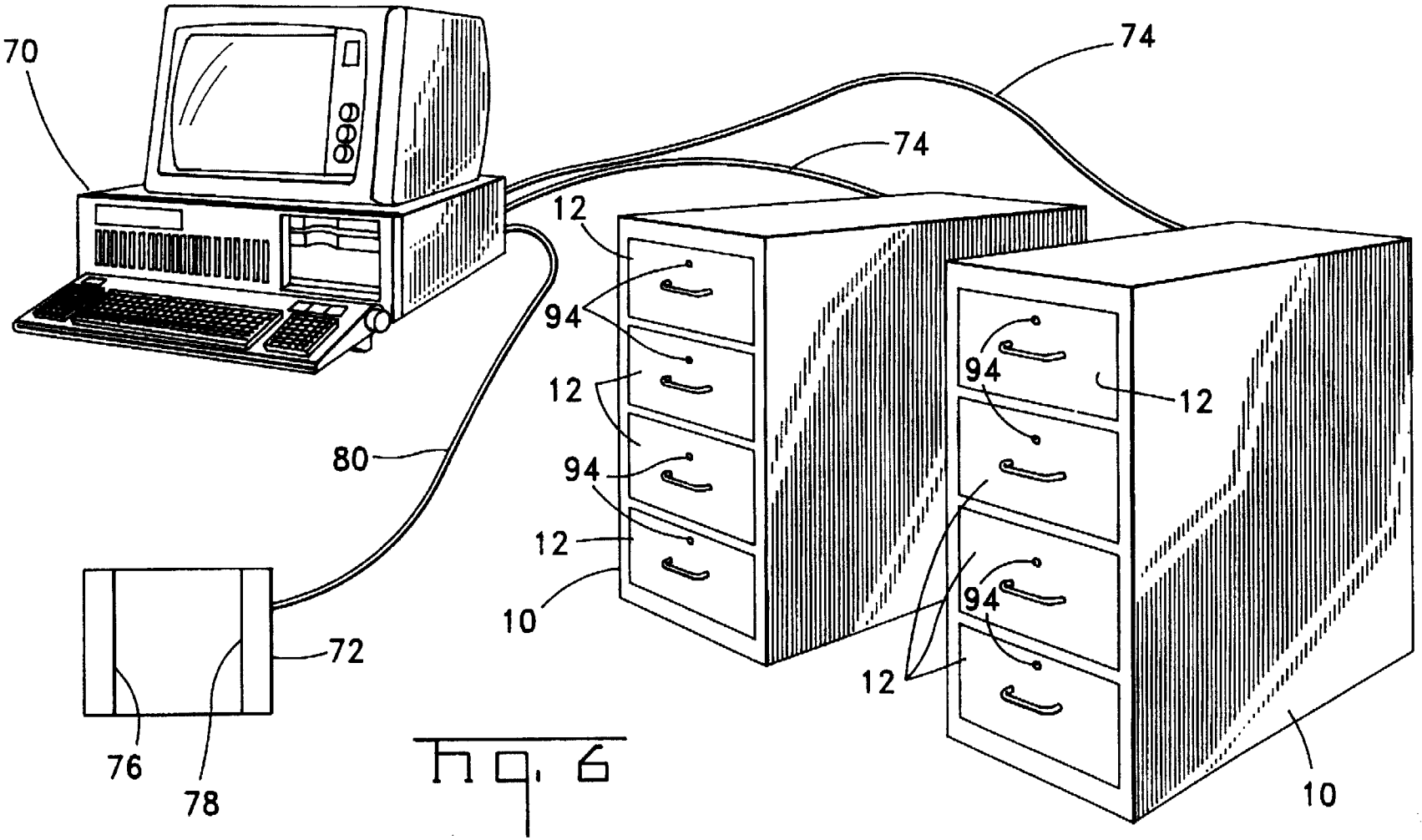
FIG. 6 schematically depicts a system according to this invention comprising a plurality of file cabinets, a computer and a folder memory writing station.

FIG. 6 illustrates an electronic file folder locator system according to this invention which includes a computer 70 connected to a pair of file cabinets 10 and a folder memory writing station 72. The file cabinets 10 have been disclosed hereinabove, and the wires 58, 60 connected to each of the frames 52 within the drawers 12 are connected in parallel within each of the file cabinets 10 and then run within the cables 74 for connection to the computer 70 in a star-wired manner. The folder memory writing station 72 includes a pair of support rails 76, 78 which correspond to the rails 54, 56 and may, in fact, be part of a small frame which only has to support a single folder 14. The wires connected Go the rails 76, 78 are connected to the computer 70 as part of the cable 80 in the same star-wired arrangement as the cables 74.

Figure 7:
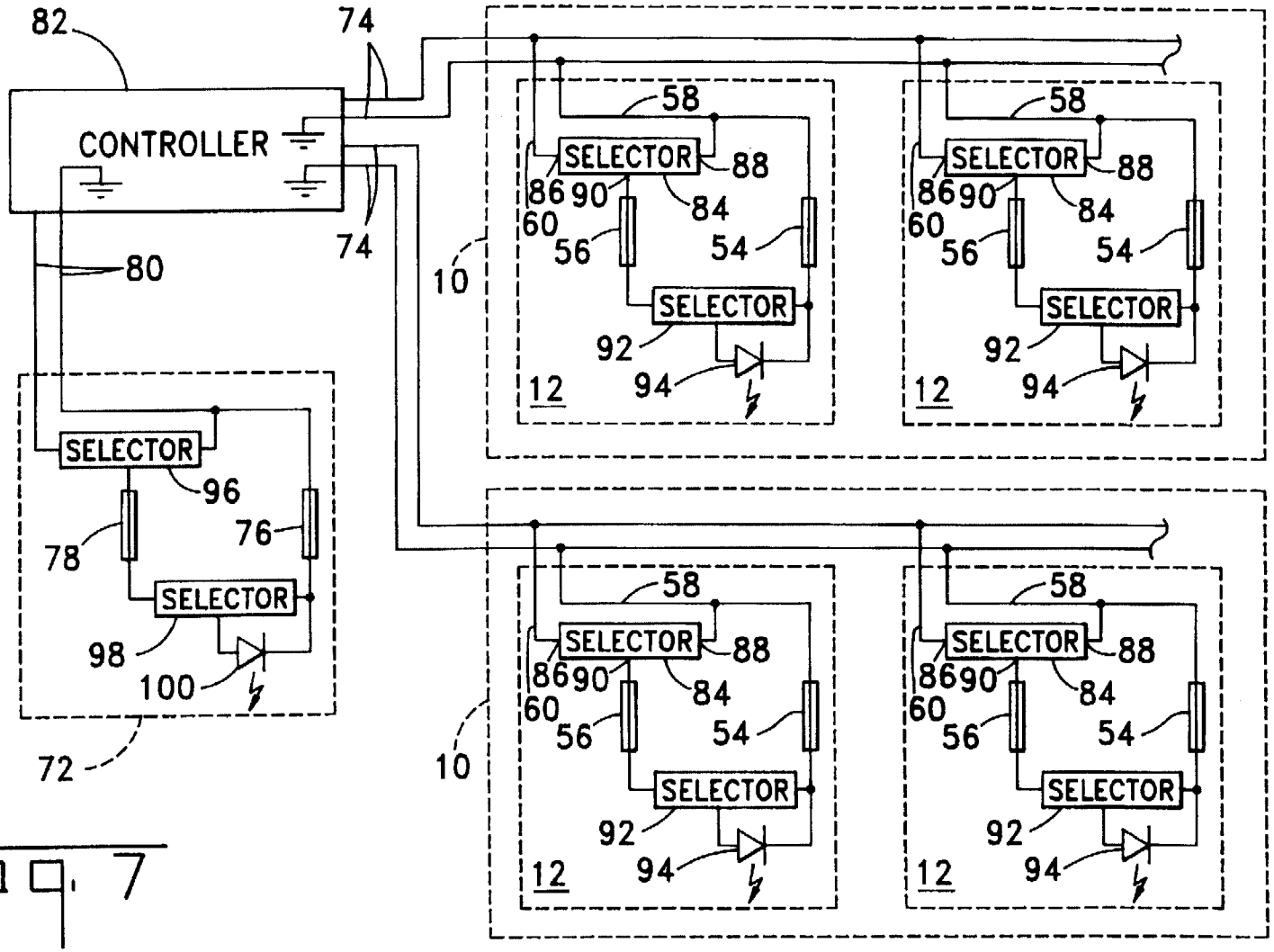
FIG. 7 is a block diagram of illustrative circuitry for the system of FIG. 6.

Referring to FIG. 7, the controller 82, which may include the computer 70 (FIG. 6), is connected to the file cabinets 10 and the writing station 72 by the cables 74 and 80 in a star-wired network. The cables 74, 80 form a communications bus. To couple the conductive lines on the support rails 54, 56 within each drawer 12 to the communications bus, there is provided a selector 84, which is illustratively a Dallas Semiconductor type 240X address switch. As described above with respect to the chip 44 of the label holder 26, such a device is a three terminal integrated circuit chip. The terminal 86 is the data/power terminal of the chip; the terminal 88 is the ground terminal of the chip; and the terminal 90 is the input/output terminal of the chip. This type of chip responds to interrogation signals at its data/power terminal 86 to provide its identification number at the data/power terminal 86 and responds to commands having that identification number embedded therein for opening up its input/output terminal 90 to allow subsequent signals received at its data/power terminal 86 to pass therethrough. Accordingly, the controller 82 can choose one of the file cabinet drawers 12 by sending appropriate instructions to the selector 84 associated with that drawer and interrogate the chips 44 of the label holders 26 of all of the hanging folders 14 supported by the rails 54, 56 in that drawer. Further, each drawer 12 has a selector 92 having a light emitting diode 94 mounted on the outside of the drawer and connected between the input/output terminal and the ground terminal of the selector 92, so that it is selectively energizable, in the same manner as the light emitting diode 50 of the label holder 26. The folder memory writing station 72 is configured similarly, with selectors 96 and 98 and light emitting diode 100.

The system functions as follows. When a user wishes to place a file in one of the filing cabinets 10 for the first time, a hanging folder 14 with an attached label holder 26 is taken from some storage location and placed in the writing station 72, where it is supported by the rails 76, 78. By using the computer 70 (i.e., the controller 82), the user provides identification information to be stored in the memory of the Dallas Semiconductor type 240X chip 44 in the label holder 26 of that folder 14. The controller 82 passes that information through the selector 96, to the conductive line on the rail 78 to the chip 44. The identification information is then stored in the memory of the chip The folder 14 may then be removed from the writing station 72 and placed within any drawer 12 of any of the filing cabinets 10 connected in the network. At some time, either as a part of a normal routine or upon command from a user, the controller 82 interrogates the chips 44 in all of the label holders 26 on all of the folders 14 in all of the file cabinet drawers 12 to determine which folders 14 are within each of the drawers 12. The controller 82 makes a list associating the drawers and the folders contained therein.

When a user desires to locate a particular folder, the identification information is entered into the controller 82. The controller 82 uses the aforedescribed list to determine which drawer contains that folder. The controller 82 then attempts to interrogate that folder in that drawer to verify that the folder is actually there. If not, the controller 82 interrogates the folders in the remaining drawers to determine the location of the desired folder. In any event, when the desired folder is located, appropriate instruction signals are sent to cause the selector 92 in that drawer 12 to energize the corresponding light emitting diode 94 on the outside of the drawer. Also, the chip 44 on the label holder 26 of that folder is sent an instruction to energize the light emitting diode 50. Accordingly, the user is made aware of which drawer contains the desired folder and upon opening that drawer can immediately identify the desired folder.

Although a specific writing station 72 has been disclosed, an alternative system construction would allow the system controller to recognize when a new folder is added to a drawer, and user entered identification information could be sent to that folder within the drawer.

A further alternative construction would have the chip 44 and light emitting diode 50 of the label holder 26 mounted directly to the support bar 22.

It is also understood that the hanging folder 14 must be placed on the rails 54, 56 with the proper polarity. Accordingly, there has been disclosed an improved electronic system for monitoring and indicating the location of file folders within a filing system. While an illustrative embodiment of the present invention has been disclosed herein, it is understood that various modifications and adaptations to the disclosed embodiment will be apparent to those of ordinary skill in the art and it is intended that this invention be limited only by the scope of the appended claims.

What is claimed is:

1. A monitoring arrangement associated with a hanging file folder for identifying information in an electronic file folder locator system having a communications bus, a hanging file folder having a pair of laterally extending support bars along a pair of upper edges of the file folder wherein each upper edge is formed with a channel for holding a respective support bar and said file folder is formed with a plurality of apertures into one of the upper edge channels at a plurality of spaced locations along its channel, the arrangement comprising:

a pair of parallel, substantially horizontal, support rails spaced apart so that the opposite ends of the file folder support bars can each engage a respective one of the support rails to suspend the file folder from the support bars and between the support rails;

a file folder label holder containing an addressable switch and a memory storing identifying information unique to the file folder, the label holder having a tab adapted to extend into a file folder upper edge aperture for mounting the label holder to said file folder;

a first pair of conductive lines extending along at least one of said support rails and adapted for connection to the communications bus of the electronic file folder locator system;

a second pair of conductive lines extending along the one support bar within its channel of the file folder having the plurality of apertures, the second pair of conductive lines being located on the one support bar for contact with respective ones of the first pair of conductive lines when the file folder is supported on the pair of support rails; and circuitry within the label holder coupled to the addressable switch and the memory, the circuitry extending onto a surface of the label holder tab and adapted for contact with the second pair of conductive lines when the tab is inserted into one of the apertures.

2. The arrangement according to claim 1 wherein:

each of said first pair of conductive lines is on a respective one of said support rails; and the second pair of conductive lines is in parallel spaced relation on a surface of said one support bar and extend along substantially the entire length of said one support bar, with each of the second pair of conductive lines extending to a respective opposite end of said one support bar to contact the one of said first pair of conductive lines which is on the support rail engaged by that end of said one support bar.

3. The arrangement according to claim 2 wherein:

said label holder includes a pair of tabs each extending from an opposed lateral edge of said label holder and adapted for insertion into respective ones of a pair of spaced apertures, each of said tabs having circuitry on a surface thereof adapted to contact a respective one of said second pair of conductive lines on said one support bar.

4. The arrangement according to claim 1 wherein the label holder further contains selectively energizable visible indicator means coupled to the circuitry and the addressable switch.

5. The arrangement according to claim 4 wherein there are a plurality of said file folders and the electronic file folder locator system comprises:

control means coupled to said communications bus and being effective for receiving a folder location request including identifying information unique to the requested file folder, for receiving identifying information from said plurality of file folders, for comparing the identifying information of the request with the identifying information of the plurality of file folders, for identifying a particular file folder having identifying information matching the identifying information of the request, and for energizing the indicator means of said particular file folder.

6. The arrangement according to claim 5 wherein the support rails are installed in a drawer of a file cabinet and the electronic file folder locator system further includes circuitry associated with said drawer and coupled to said communication bus, said circuitry including selectively energizable visible indicator means visible on an exterior surface of said file cabinet drawer and an addressable switch, the control means being further effective for energizing the indicator means of said drawer when said particular file folder is within said drawer.

* * * * *